US009091112B2

(12) United States Patent
Millman et al.

(10) Patent No.: US 9,091,112 B2
(45) Date of Patent: Jul. 28, 2015

(54) SECURITY PANELS FOR COVERING WINDOW AND DOOR OPENINGS IN BUILDING STRUCTURES

(71) Applicants: Scott R. Millman, Farmington Hills, MI (US); Justin A. Comstock, Lake Orion, MI (US)

(72) Inventors: Scott R. Millman, Farmington Hills, MI (US); Justin A. Comstock, Lake Orion, MI (US)

( * ) Notice: Subject to any disclaimer, the term of this patent is extended or adjusted under 35 U.S.C. 154(b) by 0 days.

(21) Appl. No.: 14/194,988

(22) Filed: Mar. 3, 2014

(65) Prior Publication Data

US 2014/0245673 A1 Sep. 4, 2014

Related U.S. Application Data

(60) Provisional application No. 61/772,439, filed on Mar. 4, 2013.

(51) Int. Cl.

| | |
|---|---|
| ***E06B 9/02*** | (2006.01) |
| ***E06B 5/02*** | (2006.01) |
| ***E06B 9/04*** | (2006.01) |

(52) U.S. Cl.

CPC . *E06B 9/02* (2013.01); *E06B 5/025* (2013.01); *E06B 9/04* (2013.01)

(58) Field of Classification Search

CPC ..... E04C 2/44; E06B 3/28; E06B 9/00
USPC ..... 52/202–203, 783.12; 244/129.3
See application file for complete search history.

(56) References Cited

U.S. PATENT DOCUMENTS

| | | | | |
|---|---|---|---|---|
| 2,370,803 | A * | 3/1945 | Kronenbitter | 52/537 |
| 2,639,876 | A * | 5/1953 | Misfeldt | 244/124 |
| 3,014,558 | A * | 12/1961 | Noyes | 52/82 |
| 3,911,630 | A * | 10/1975 | Nally | 52/2.12 |
| 4,193,232 | A * | 3/1980 | Almsted et al. | 52/98 |
| 4,432,171 | A * | 2/1984 | Boot | 52/79.1 |
| 5,466,500 | A * | 11/1995 | Pluim | 428/41.6 |
| 5,758,457 | A * | 6/1998 | Achen | 52/198 |
| 5,862,639 | A * | 1/1999 | Abou-Rached | 52/223.6 |
| 5,918,430 | A * | 7/1999 | Rowland | 52/202 |
| 5,996,292 | A * | 12/1999 | Hill et al. | 52/202 |
| 8,656,664 | B2 * | 2/2014 | Glass et al. | 52/202 |
| 8,726,588 | B2 * | 5/2014 | Jakus et al. | 52/203 |
| 2007/0245672 | A1 * | 10/2007 | Herlache et al. | 52/602 |
| 2009/0100781 | A1 * | 4/2009 | Hatamian et al. | 52/578 |
| 2012/0324804 | A1 * | 12/2012 | Smith | 52/106 |
| 2013/0326973 | A1 * | 12/2013 | Rivera | 52/202 |

FOREIGN PATENT DOCUMENTS

GB 190424381 A * 10/1905

* cited by examiner

*Primary Examiner* — Jeanette E Chapman
(74) *Attorney, Agent, or Firm* — Young Basile Hanlon & MacFarlane PC

(57) ABSTRACT

A security panel apparatus and a method for covering window and door openings in building structures using the security panel apparatus are disclosed. One example security panel includes a main panel section including stiffening bends extending diagonally between opposite corners of the main panel section. The security panel also includes a plurality of side flanges extending away from the main panel section toward the opening in the building structure when the security panel is in an installation position and a plurality of edge sections each extending away from one of the side flanges in a direction generally parallel to the main panel section. The security panel also includes a plurality of apertures formed in at least one of the edge sections.

19 Claims, 4 Drawing Sheets

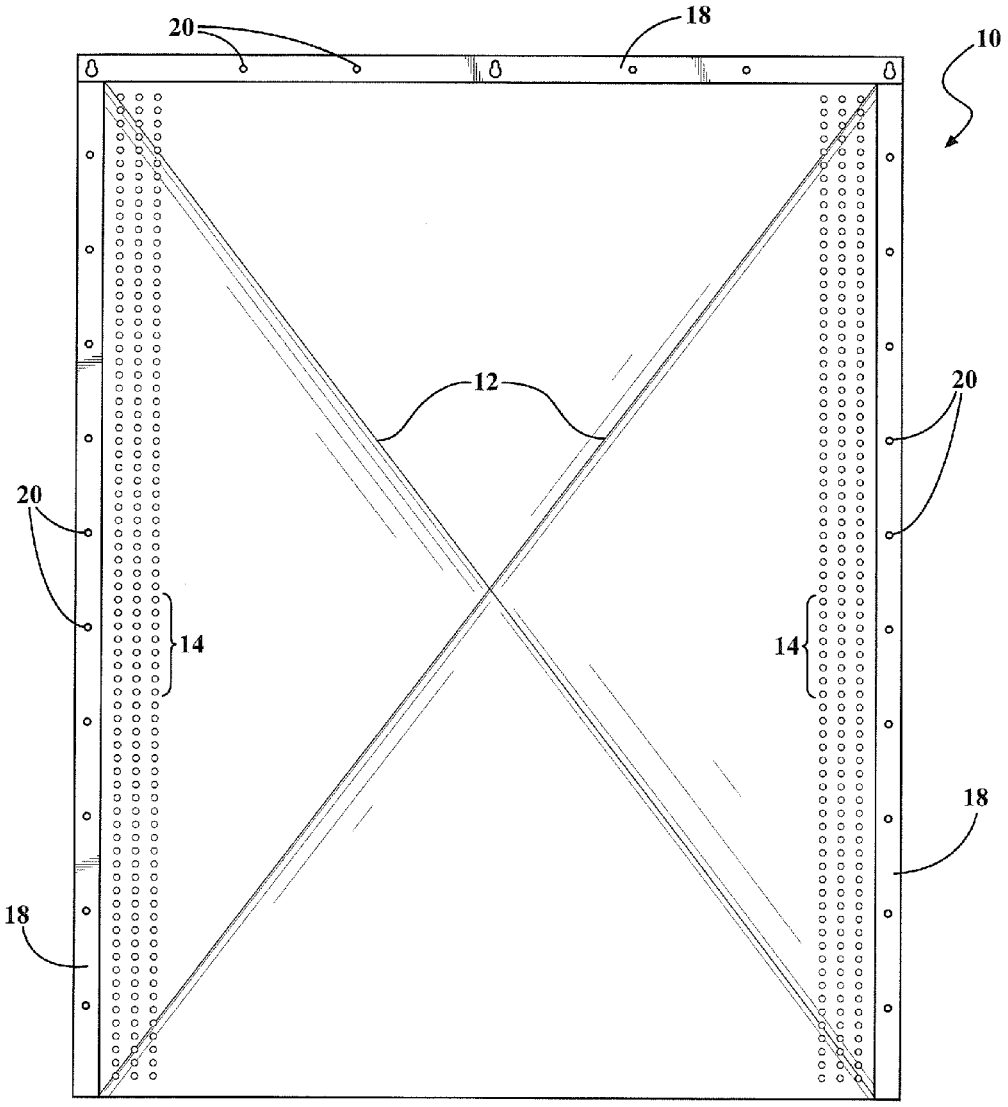
FIG. 1A
FIG. 1B
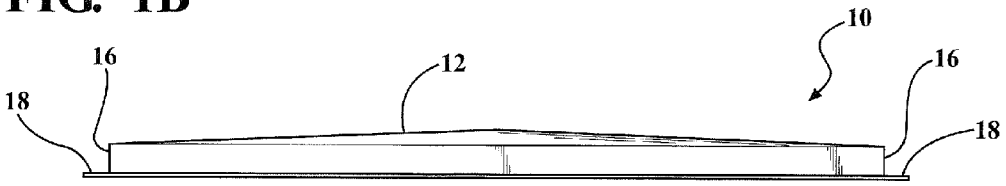

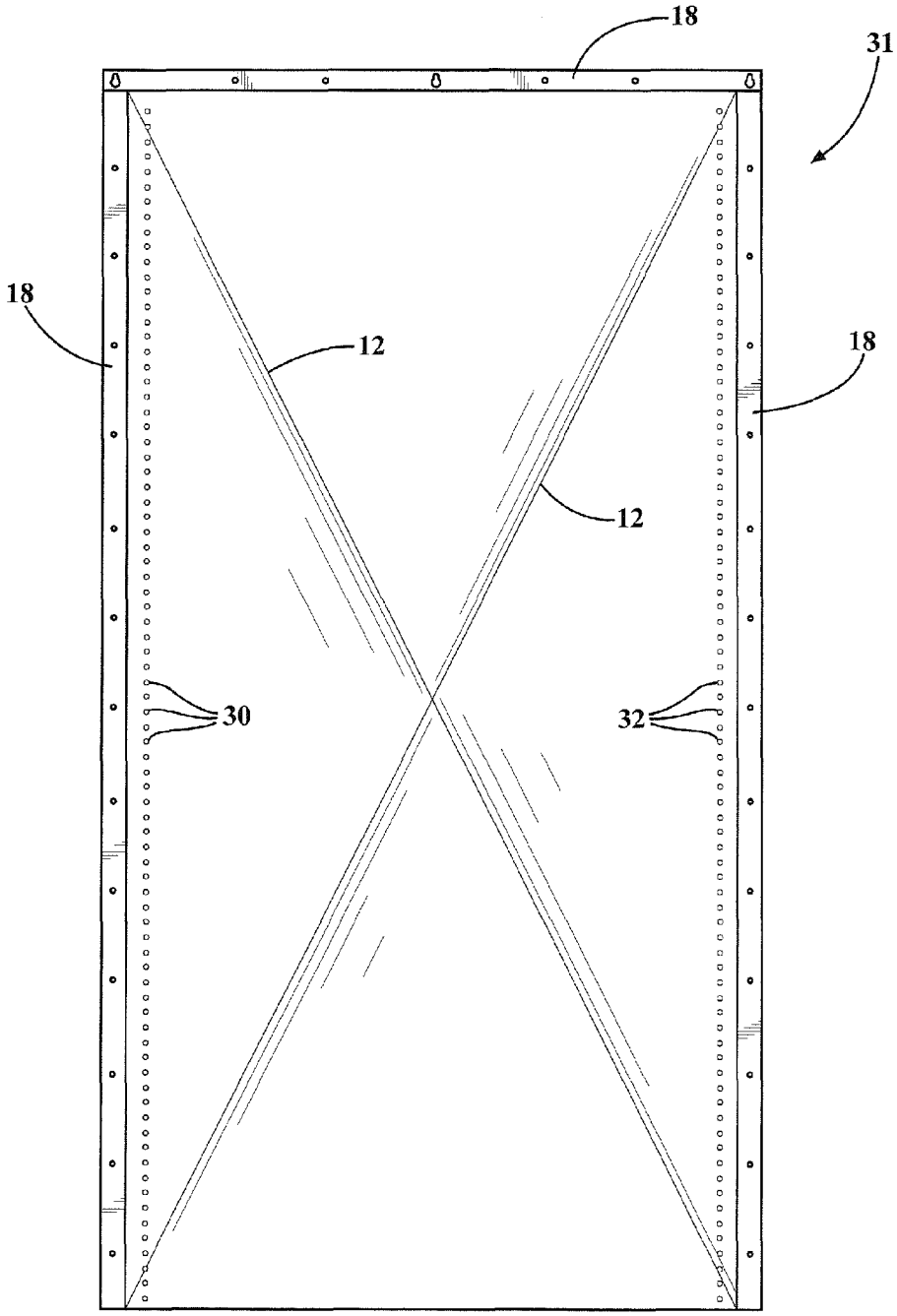
FIG. 3A
FIG. 3B
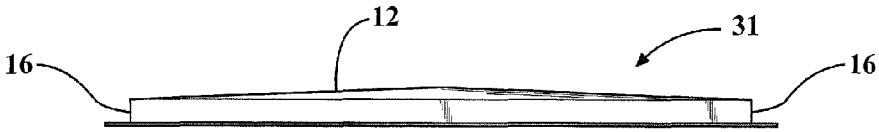

SECURITY PANELS FOR COVERING WINDOW AND DOOR OPENINGS IN BUILDING STRUCTURES

CROSS-REFERENCE TO RELATED APPLICATION

This application claims the benefit of U.S. Provisional Patent Application Ser. No. 61/772,439, filed Mar. 4, 2013. The contents of the '439 application are incorporated herein by reference.

BACKGROUND

When buildings are unoccupied for long periods of time, or abandoned, and there is a need to prevent unauthorized persons from gaining access to the building through window and door openings, it is a common practice to "board up" the openings using plywood panels attached to the building by nails, bolts, or screws so as to cover these openings.

However, the plywood tends to deteriorate over time as a result of weathering and the like, and the plywood panels may be relatively easily broken open by determined vandals and the like to allow entry into the building.

SUMMARY

Various apparatuses for covering windows and door openings in building structures and methods for installing the apparatuses are disclosed.

In one implementation, a security panel apparatus for covering an opening in a building structure is disclosed. The security panel apparatus comprises a main panel section including stiffening bends extending diagonally between opposite corners of the main panel section; a plurality of side flanges extending away from the main panel section toward the opening in the building structure when the security panel is in an installation position; a plurality of edge sections each extending away from one of the side flanges in a direction generally parallel to the main panel section; and a plurality of apertures formed in at least one of the edge sections.

In another implementation, a method of installing a security panel apparatus is disclosed. The method includes installing a plurality of locating fasteners proximate to one or more edges of an opening in a building structure and aligning a security panel over the opening in the building structure. The security panel includes a main panel section including stiffening bends extending diagonally between opposite corners of the main panel section; a plurality of side flanges extending away from the main panel section toward the opening in the building structure when the security panel is aligned with the opening in the building structure; and a plurality of edge sections each extending away from one of the side flanges in a direction generally parallel to the main panel section. The method further includes hanging the security panel from the plurality of locating fasteners and securing the security panel to the building structure over the opening.

In another implementation, a security panel apparatus for covering an opening in a building structure and allowing access to the building structure is disclosed. The security panel includes a main panel section defining an access opening; a hinged front panel secured by a hinge to the main panel section covering the access opening and configured to allow authorized access to the opening in the building structure; a plurality of side flanges extending away from the main panel section toward the opening in the building structure when the security panel is in an installation position; and a plurality of edge sections each extending away from one of the side flanges in a direction generally parallel to the main panel section.

BRIEF DESCRIPTION OF THE DRAWINGS

The description makes reference to the accompanying drawings wherein like reference numerals refer to like parts throughout the several views, and wherein:

FIG. 1A illustrates an example window security panel in front view

FIG. 1B illustrates the window security panel of FIG. 1A in end view;

FIG. 3A illustrates an example door security panel in front view;

FIG. 3B illustrates the door security panel of FIG. 3A in end view;

DETAILED DESCRIPTION

Figure 2A:
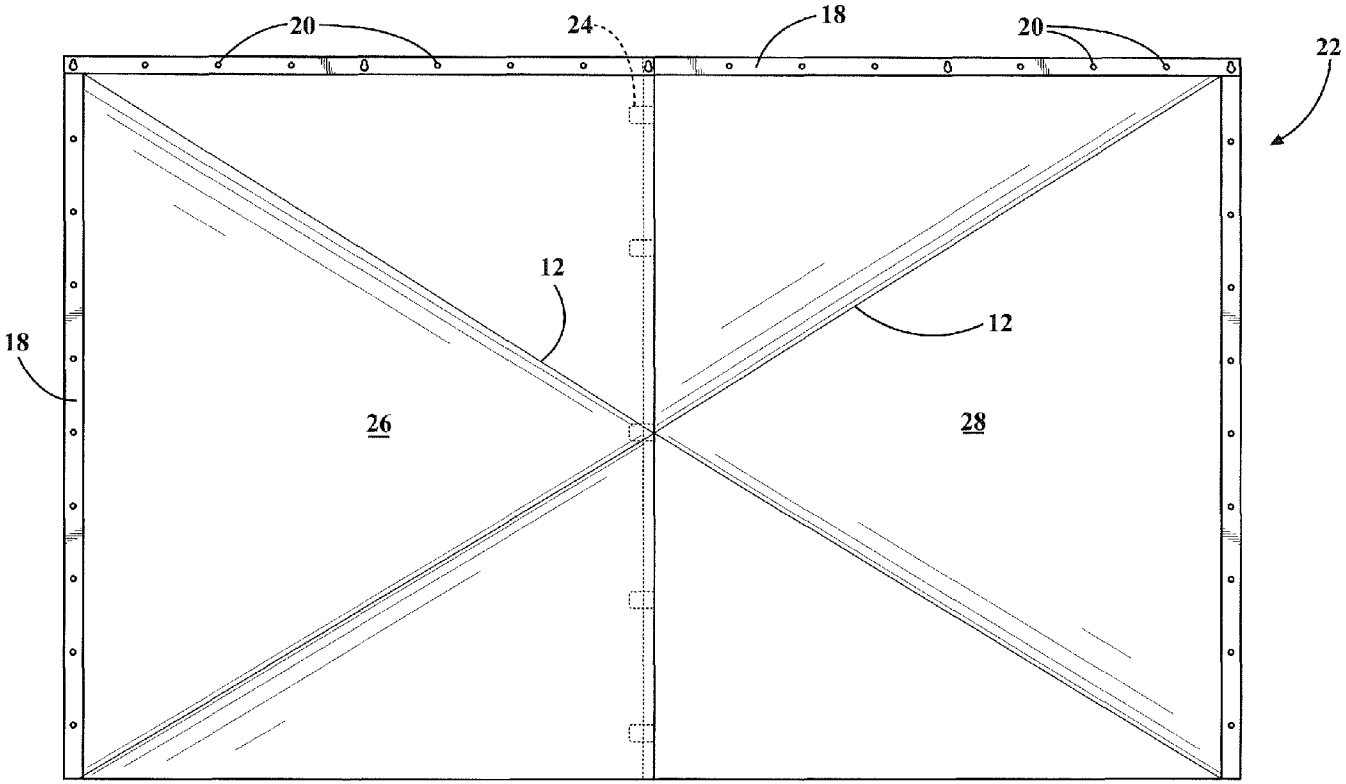
FIG. 2A illustrates another example window security panel in front view.

The present disclosure is accordingly directed toward security panel structures sized to fit over window and door openings, with configurations that allow secure attachment of the security panels to the building. These security panels, for example, when constructed of sheet metal, can provide a substantially higher degree of security than wood panels and resist deterioration due to weather and aging.

The security panels can include main panel sections of generally rectangular shape having a size sufficient to cover common window or door openings. The main panel section can be stiffened by diagonally extending, intersecting stiffening bends extending out of the front of the main panel section. Side flanges can extend normally to the main panel section along at least some of the edges of the security panel. In one example, the side flanges can include side edge sections having 90 degree bends extending away from the main panel section of the security pane.

The security panels may also incorporate different types of apertures or holes along the edges of the main panel section and along the side flanges or side edge sections. Some types of holes can receive fasteners. For example, threaded fasteners such as self-threading screws, bolts, or nails may be passed through the holes in the side flanges, side edge sections, or main panel section to secure the security panels about the building openings. Other types of holes can allow ventilation, transmit light, or provide locating features for installation of the security panels.

In one embodiment, a main panel section of a door-covering-style security panel may be joined to a side flange by a piano hinge on one side, with lock openings or hasps secured by locks on the opposite side, in order to allow access to the building by authorized persons. In some embodiments, these hinged-style security panels are used on one of the doors of a building structure to allow secured entry through the security panel.

FIGS. 1A and 1B illustrate an example window security panel 10 in front view and end view. The illustrated window security panel 10, like the other security panels described herein, may be produced in a number of sizes to fit common building openings or may be customized to fit uniquely sized building openings. In the case of FIGS. 1A and 1B, the window security panel 10 has a height of approximately 60 inches and a width of approximately 47 inches to cover a slightly smaller window opening. The window security panel 10 may be formed of sheet metal, such as 16-gauge galvanized and annealed steel. The window security panel 10 can also include stiffening bends 12 that extend diagonally between the corners of the window security panel 10 and constitute sections bent slightly out of the plane of the window security panel 10 toward its forward side, away from the building when the window security panel 10 is installed. These stiffening bends 12 are sometimes termed "press brake lines," referring to the machine in which they are formed.

Side edges of the main panel section of the window security panel 10 of FIGS. 1A and 1B can be formed with an array of small holes 14. In the example embodiment, there are three lines of holes 14 on each side of the main panel section. In this example, the holes 14 constitute quarter-inch diameter holes on one inch centers, although other sizes and spacing can be used in other embodiments. These holes 14 can have several purposes: first, the holes 14 can receive various fasteners in order to attach the window security panel 10 to a building; second, the holes 14 can allow for ventilation from the building; third, the holes 14 can allow for light transmission into the building.

As illustrated in the end view in FIG. 1B, the window security panel 10 includes three side flanges 16 (only two of which are illustrated in the end view of FIG. 1B) bent at 90 degrees away from the main panel section toward the building when the window security panel 10 is in an installation position. These side flanges 16 may also be formed on a press brake. In one embodiment, the side flanges 16 can have a width of 1.87 inches. The side flanges 16 can also terminate in side edge sections 18, the side edge sections 18 being bent generally parallel to and projecting away from the main panel section. In the example shown in FIG. 1A, the side edge sections 18 are formed with spaced holes 20.

The holes 20 in the side edge sections 18 can also have several purposes: first, the holes 20 can receive various fasteners in order to attach the window security panel 10 to a building; second, the holes 20 can be used for locating purposes, being oversized in at least one dimension such that a worker installing the window security panel 10 can use one or more of the holes 20 to position the window security panel 10 before installation. In one example, the holes 20 can have a tear-drop shape well suited for locating purposes in that the larger portion of the hole 20 fits easily over one of the locating fasteners when aligning the window security panel 10 to the building structure and the smaller portion of the hole 20 allows the window security panel 10 to be hung in the installation position. Several tear-drop shaped holes are shown in FIG. 1A along the top-most side edge section 18 of the window security panel 10. In another example, the holes 20 are located on 6 inch centers suitable for attachment purposes.

The window security panel 10 of FIGS. 1A and 1B may be secured to a window frame (not shown), so that the window security panel 10 covers the window opening, by using appropriate fasteners extending through either or both of the holes 14 or 20. Example fasteners include nails, screws, or bolts which may be joined to sockets laid into the window security panel 10.

Figure 2B:
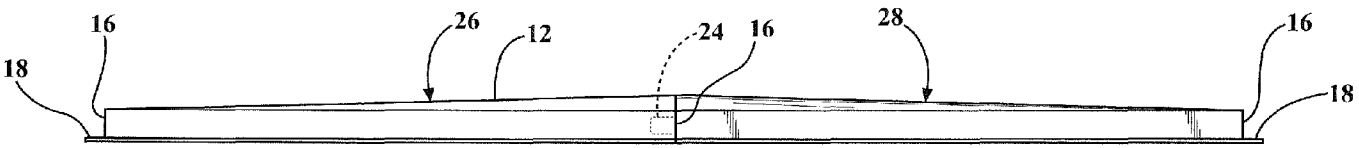
FIG. 2B illustrates the window security panel of FIG. 2A in end view.

FIGS. 2A and 2B illustrate another example window security panel 22 in front view and end view. In this example, the window security panel 22 can cover a picture window, which is about twice the width of the smaller size window covered by the window security panel 10 of FIGS. 1A and 1B and is approximately the same height. This example window security panel 22 lacks the array of holes 14 present on the main panel section of the window security panel 10 of FIG. 1A, but includes the array of holes 20 present in corresponding side edge sections 18. Additionally, the window security panel 22 of FIGS. 2A and 2B can be formed from two panel sections 26, 28 which are overlapped and connected together.

The connection between the panel sections 26, 28 can be made as follows: the panel section 26 can include a side flange 16 abutting another side flange 16 on the panel section 28. One of these abutting side flanges 16 can include spaced slot openings (not shown). The other of these abutting side flanges 16, in this example, that of panel section 28, can include spaced tongues, or tabs 24, that fit into the spaced slot openings. The use of tabs 24 and slot openings allows for easier installation of the panel sections 26, 28 of the window security panel 22 since it provides both locating and locking features between the panel sections 26, 28.

FIGS. 3A and 3B illustrate an example door security panel 31 in front view and end view. The door security panel 31 is intended for use with any of the doors that allow entry to and exit from the building. The door security panel 31 can be rectangular in dimension and adapted to cover a typical door frame opening. On opposed side edges of the main panel section, door security panel 31 includes lines of holes 30, 32. The lines of holes 30, 32 can be used, for example, to fasten the door security panel 31 to a door frame opening or to allow light, airflow, or ventilation to enter and exit the building. In one example, the holes 30, 32 are equally spaced and quarter-inch sized. Other than the difference in the holes 30, 32, the door security panel 31 is very similar to the previously described window security panels 10, 22. For example, the door security panel 31 can include stiffening bends 12 that extend diagonally between the corners and three side flanges 16 bent at 90 degrees away from a main panel section that terminate in side edge sections 18 bent generally parallel to and projecting away from the main panel section.

Figure 4:
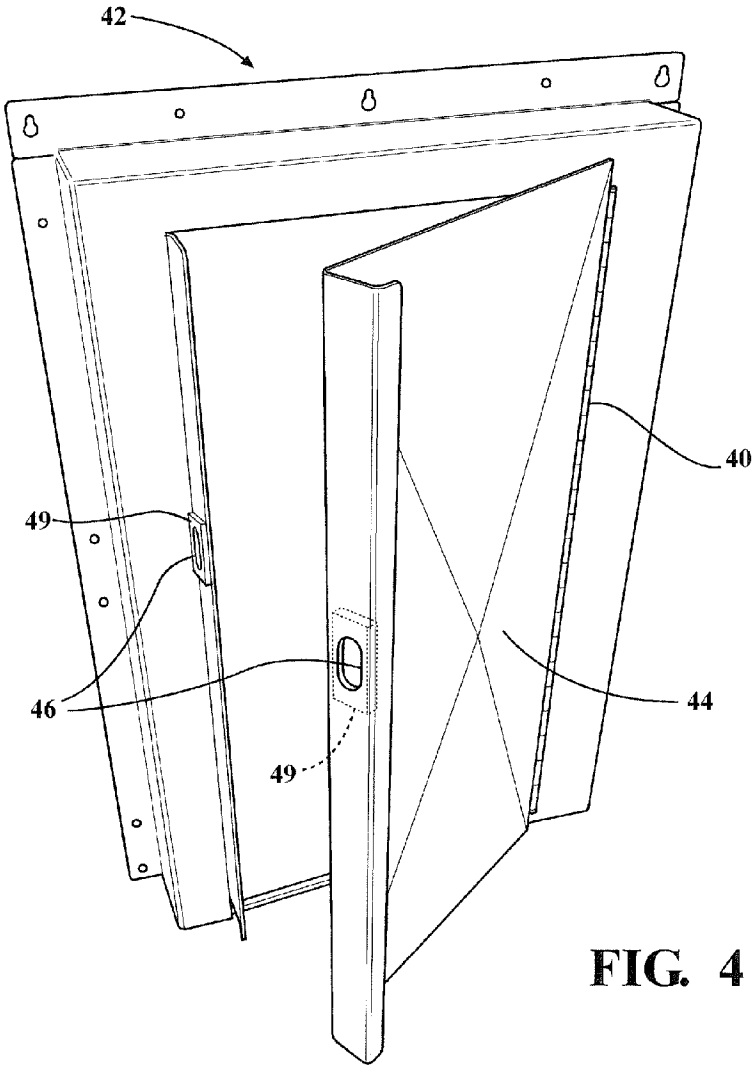
FIG. 4 illustrates another example door security panel in perspective view.

FIG. 4 illustrates another example door security panel 42 in perspective view. The door security panel 42 is similar to the door security panel 31 of FIGS. 3A and 3B, but it additionally includes a hinged front panel 44. The hinged front panel 44 is secured by a hinge 40 to the main panel section of the door security panel 42 such that authorized access may be gained through the door behind the door security panel 42. The side of the hinged front panel 44 located opposite to the hinge 40 can also include a lock opening 46, for example, located on a bent flange section. The lock opening 46 allows the hinged front panel 44 to be locked or closed to the main panel section of the door security panel 42 using one or more combination locks or the like while still allowing access by authorized personnel to the building using the door opening behind the door security panel 42. The main panel section of the door security panel 42 can also include a lock opening 46 corresponding in location to the lock opening 46 in the hinged front panel 44, for example, located on a bent flange section.

Either or both of the bent flanged sections of the hinged front panel 44 and the main panel section can include a doubler plate 49 proximate to the location of the lock openings 46. The doubler plate 49 can increase the thickness of either or both of the bent flanged sections proximate to the lock openings 46 in a range from one-quarter to three-eighths of an inch. The added thickness from the doubler plates 49 near the lock openings 46 can prevent the door frame beneath the door security panel 42 or the door itself from being manipulated such that unauthorized access could be gained to the building. One or more doubler plates 49 can also serve to protect from a lock being removed from the lock openings 46.

Figure 5:
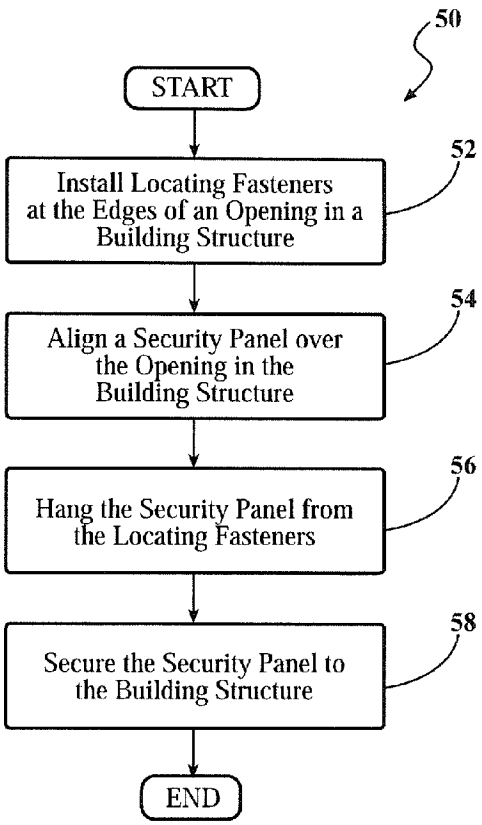
FIG. 5 illustrates an example process for installing a security panel over a window or door opening in a building structure.

FIG. 5 illustrates an example process 50 for installing a security panel, for example, the window security panel 10 of FIGS. 1A and 1B or the door security panel 31 of FIGS. 3A and 3B, over a window or door opening in a building structure. The security panel can be constructed such that it will cover the entire opening in order to keep air, dirt, weather, and unauthorized persons out of the building structure. Alternatively, the security panel can be constructed to cover most of the opening in the building structure, leaving only a top portion of the opening uncovered. The opening can prepped for security panel installation by a worker identifying and removing any obstructions near the opening that would impede installation of the security panel. The security panel, or several security panels, can be selected for use with the opening after a worker measures the opening.

Once the properly-sized security panel(s) has been selected, a worker can install a plurality of locating fasteners proximate to one or more edges of the opening in a building structure in step 52 of the process 50. For example, the locating fasteners can be secured into holes drilled directly into the building structure outboard of several corners of the opening. Installing the locating fasteners directly to the building structure can make the installation of the security panel as structurally sound as possible to avoid removal of the security panel. The position of the locating fasteners is also dependent on the number of security panels being used to cover the opening. If, for example, two security panels are being used to cover the opening, additional support means, such as a vertical wooden support, can be added in the center of the opening and locating fasteners can be attached to the additional support means.

In step 54 of the process 50, a worker can align the security panel to be installed over the opening in the building structure. The security panel can be similar to the window security panel 10 shown in FIG. 1A, including a main panel section with stiffening bends 12 extending diagonally between opposite corners of the main panel section, a plurality of side flanges 16 extending away from the main panel section toward the opening in the building structure when the security panel is aligned with the opening in the building structure, and a plurality of side edge sections 18 each extending away from one of the side flanges 16 in a direction generally parallel to the main panel section.

The security panel can also include apertures formed in at least one of the side edge sections, such as the holes 20 formed in the side edge sections 18 of the window security panel 10 shown in FIG. 1A. At least some of these apertures can be configured to allow the security panel to be hung from the plurality of locating fasteners in an installation position. For example, the apertures can have a tear-drop shape, such as is shown in several locations along the topmost side edge section 18 in FIG. 1A, suitable to allow a worker to easily position the security panel over the locating fasteners and hang the security panel from the locating fasteners. Some of the apertures can be configured to allow the security panel to be secured to the building structure over the opening. Additionally, the security panel can include apertures formed in the main panel section, such as the holes 14 formed in the main panel section of the window security panel 10 shown in FIG. 1A. At least some of the apertures in the main panel section can be configured to allow the security panel to be secured to the building structure over the opening and others can be configured to allow light, airflow, or ventilation, to pass through the security panel from the opening in the building structure.

In step 56 of the process 50, a worker can hang the security panel from one or more of the of locating fasteners, for example, by sliding some of the apertures in either the main panel section or one or more of the edge sections over the locating fasteners and allowing the locating fasteners to support the security panel against the building structure. In one example, at least one locating fastener is installed centrally above the top of the opening in the building structure in order to center the security panel before hanging it in the installation position.

In step 58 of the process 50, a worker can secure the security panel to the building structure over the opening, for example, using securing fasteners installed through apertures in the main panel section, edge sections, or side flanges. In one example, a pair of workers can secure the security panel to the building structure after it has been located in the installation position. In this example, a first worker partially secures the fasteners through the relevant apertures and a second worker fully tightens the fasteners to finish the installation. In one embodiment, the bottom edge of the security panel will rest on a lower window sash or a door threshold once secured into position over the opening. After step 58, the process 50 ends.

The foregoing description relates to what are presently considered to be the most practical embodiments. It is to be understood, however, that the disclosure is not to be limited to these embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A security panel for covering an opening in a building structure, comprising:

a main panel section including a pair of intersecting stiffening bends extending diagonally between opposite corners of the main panel section and away from the building structure when the security panel is in an installation position to form a peak at the intersection of the stiffening bends;

a plurality of side flanges extending normally from the main panel section toward the opening in the building structure when the security panel is in the installation position;

a plurality of edge sections each extending away from one of the side flanges in a direction generally parallel to the main panel section wherein the plurality of edge sections are spaced from the main panel section by the plurality side flanges such that both the plurality of side flanges and the plurality of edge sections abut a portion of the building structure in the installation position; and a plurality of apertures formed in at least one of the edge sections and at least one of the side flanges.

2. The security panel of claim 1, wherein at least some of the plurality of apertures in the at least one edge section and the at least one side flange are configured to allow the security panel to be secured to the building structure over the opening.

3. The security panel of claim 1, wherein at least some of the plurality of apertures are configured to allow the security panel to be hung in the installation position from a plurality of locating fasteners installed proximate to one or more edges of the opening in the building structure.

4. The security panel of claim 1, further comprising:

a plurality of apertures formed in the main panel section.

5. The security panel of claim 4, wherein at least some of the plurality of apertures formed in the main panel section are configured to allow the security panel to be secured to the building structure over the opening.

6. The security panel of claim 4, wherein at least some of the plurality of apertures formed in the main panel section are configured to allow light and airflow to pass through the security panel from the opening in the building structure.

7. The security panel of claim 1, wherein the security panel is a first security panel and wherein at least some of the plurality of apertures formed in the at least one of the side flanges are configured to allow a second security panel to be secured to the first security panel.

8. The security panel of claim 7, wherein the second security panel includes a plurality of tabs configured to allow the second security panel to be secured within the plurality of apertures formed in the at least one side flange of the first security panel.

9. A method, comprising:

aligning a security panel over an opening in a building structure, wherein the security panel comprises:

a main panel section including a pair of intersecting stiffening bends extending diagonally between opposite corners of the main panel section and away from the building structure when the security panel is aligned over the opening in the building structure to form a peak at the intersection of the stiffening bends;

a plurality of side flanges extending normally from the main panel section toward the opening in the building structure when the security panel is aligned over the opening in the building structure;

a plurality of edge sections each extending away from one of the side flanges in a direction generally parallel to the main panel section wherein the plurality of edge sections are spaced from the main panel section by the plurality side flanges such that both the plurality of side flanges and the plurality of edge sections abut a portion of the building structure in the installation position; and a plurality of apertures formed in at least one of the edge sections and at least one of the side flanges;

hanging the security panel from a plurality of locating fasteners, the plurality of locating fasteners proximate to one or more edges of the opening in the building structure; and securing the security panel to the building structure over the opening.

10. The method of claim 9, wherein at least some of the plurality of apertures are configured to allow the security panel to be hung from the plurality of locating fasteners in an installation position.

11. The method of claim 9, wherein at least some of the plurality of apertures are configured to allow the security panel to be secured to the building structure over the opening.

12. The method of claim 9, wherein the security panel further comprises:

a plurality of apertures formed in the main panel section.

13. The method of claim 12, wherein at least some of the plurality of apertures are configured to allow the security panel to be secured to the building structure over the opening.

14. The method of claim 12, wherein at least some of the plurality of apertures are configured to allow light and airflow to pass through the security panel from the opening in the building structure.

15. The method of claim 9, wherein the security panel is a first security panel and wherein at least some of the plurality of apertures formed in the at least one of the side flanges are configured to allow a second security panel to be secured to the first security panel.

16. The method of claim 15, wherein the second security panel includes a plurality of tabs configured to allow the second security panel to be secured within the plurality of apertures formed in the at least one side flange of the first security panel.

17. A security panel for covering an opening in a building structure and allowing authorized access to the building structure, comprising:

a main panel section defining an access opening;

a hinged front panel secured by a hinge to the main panel section for covering the access opening wherein the hinged front panel is configured to allow authorized access to the opening in the building structure and includes a pair of intersecting stiffening bends extending diagonally between opposite corners of the hinged front panel and away from the building structure when the security panel is in an installation position to form a peak at an intersection of the stiffening bends;

a plurality of side flanges extending normally from the main panel section toward the opening in the building structure when the security panel is in the installation position;

a plurality of edge sections each extending away from one of the side flanges in a direction generally parallel to the main panel section wherein the plurality of edge sections are spaced from the main panel section by the plurality side flanges such that both the plurality of side flanges and the plurality of edge sections abut a portion of the building in the installation position; and a plurality of apertures formed in at least one of the plurality of edge sections and at least one of the plurality of side flanges and wherein at least some of the plurality of apertures are configured to allow the security panel to be secured to the building structure over the opening.

18. The security panel of claim 17, wherein the security panel includes a plurality of apertures formed in at least one of the plurality of edge sections and at least one of the plurality of side flanges and wherein at least some of the plurality of apertures are configured to allow the security panel to be secured to the building structure over the opening.

19. The security panel of claim 18, wherein at least some of the plurality of apertures are configured to allow the security panel to be hung in the installation position from a plurality of locating fasteners installed proximate to one or more edges of the opening in the building structure.

* * * * *